US006997746B2

(12) United States Patent
Taylor

(10) Patent No.: US 6,997,746 B2
(45) Date of Patent: Feb. 14, 2006

(54) CRIMP CONNECTOR

(75) Inventor: Robert Taylor, Coventry, RI (US)

(73) Assignee: Ark-Les Corporation, Stoughton, MA (US)

( * ) Notice: Subject to any disclaimer, the term of this patent is extended or adjusted under 35 U.S.C. 154(b) by 0 days.

(21) Appl. No.: 10/828,156

(22) Filed: Apr. 20, 2004

(65) Prior Publication Data

US 2005/0233638 A1 Oct. 20, 2005

(51) Int. Cl.
*H01R 9/05* (2006.01)

(52) U.S. Cl. ..... 439/585; 439/865

(58) Field of Classification Search ..... 439/585, 439/877–878, 730, 587, 442, 850, 421, 882, 439/888, 865
See application file for complete search history.

(56) References Cited

U.S. PATENT DOCUMENTS

| | | | | | |
|---|---|---|---|---|---|
| 2,740,102 | A | * | 3/1956 | Paules | 439/730 |
| 3,096,136 | A | * | 7/1963 | Batcheller | 439/881 |
| 3,555,497 | A | * | 1/1971 | Watanabe | 439/857 |
| 3,670,293 | A | | 6/1972 | Garver | 439/585 |
| 3,696,322 | A | | 10/1972 | Spangler et al. | 439/422 |
| 3,892,459 | A | * | 7/1975 | Dittmann et al. | 439/442 |
| 4,139,937 | A | | 2/1979 | L'Homme | 29/754 |
| 4,298,243 | A | * | 11/1981 | Swengel et al. | 439/730 |
| 4,348,070 | A | * | 9/1982 | Simon | 439/586 |
| 4,371,229 | A | | 2/1983 | Spangler et al. | 439/865 |
| 4,614,400 | A | | 9/1986 | Tesch | 439/444 |
| 5,203,726 | A | * | 4/1993 | Quinn | 439/867 |
| 5,232,380 | A | | 8/1993 | Inoue et al. | 439/610 |
| 5,338,233 | A | * | 8/1994 | Endo et al. | 439/877 |
| 5,519,170 | A | * | 5/1996 | Nabeshima | 174/74 R |
| D400,508 | S | * | 11/1998 | Nakamura | D13/156 |
| 6,086,433 | A | * | 7/2000 | Hils et al. | 439/849 |
| 6,206,727 | B1 | | 3/2001 | Aoyama et al. | 439/585 |
| 6,384,335 | B1 | | 5/2002 | Saito et al. | 174/74 R |
| 6,517,392 | B1 | * | 2/2003 | Murakami et al. | 439/877 |
| 6,558,208 | B1 | * | 5/2003 | Suzuki | 439/878 |
| 2002/0019167 | A1 | | 2/2002 | Koide | 439/585 |

* cited by examiner

*Primary Examiner*—Hae Moon Hyeon
(74) *Attorney, Agent, or Firm*—Fish & Richardson P.C.

(57) ABSTRACT

A crimp connector includes an electrically conductive curved member having an inner surface and a leading edge extending away from and back toward the inner surface. The leading edge, curved member, and inner surface define a first volume for receiving a conductive element. The electrically conductive member, in response to an external crimping force, is configured to cause the leading edge to contact and move along the inner surface until the first volume is substantially the same as a second volume defined by the portion of the conductive element received within the first volume.

31 Claims, 7 Drawing Sheets

CRIMP CONNECTOR

BACKGROUND

This invention relates to electrical connectors and more specifically to crimp connectors.

Crimping is a pressure method for mechanically securing a terminal, splice or contact to a conductor. A crimping tool is generally used to physically compress (deform) a crimp barrel around the conductor in order to make the electrical connection. It is desirable for crimping to be performed in a single axial operation using a tool that is appropriately sized for the conductor and contact barrel.

Referring to FIG. 1A and FIG. 1B, a crimp connector 10 having a barrel 22 into which a wire is inserted is shown. The crimp connector 10 may include a fastener 12 (e.g., a rolled rail fastener) attached to the conductive barrel 22 by a transition 14.

A user inserts a wire (or other conductive element) into the conductive barrel 22 and uses a crimping tool (not shown) to permanently attach the wire to the connector 10. Referring to FIG. 1B, force applied by the crimping tool crimps and deforms the conductive barrel 22 from its original cylindrical shape (22*a*) to a flattened oval shape (22*b*). When the barrel 22 is crimped, the volume enclosed by the barrel 22 does not reduce to the volume of the wire (e.g., the contact point 18, 19 does not change significantly) which can be problematic, particularly when a wire of smaller gauge is used with the connector. Specifically, spaces 23 between the wire and conductive barrel can reduce the contact area, resulting in compromised electrical conductivity, thermal conductivity, and mechanical strength between the wire and connector 10.

SUMMARY

In one aspect of the invention, a crimp connector includes an electrically conductive curved member having an inner surface and a leading edge extending away from and back toward the inner surface, the leading edge, curved member, and inner surface defining a first volume for receiving a conductive element. The electrically conductive member, in response to an external crimping force, is configured to cause the leading edge to contact and move along the inner surface until the first volume is substantially the same as a second volume defined by the portion of the conductive element received within the first volume.

In another aspect of the invention, a method includes the following steps. A crimp connector including an electrically conductive curved member having an inner surface and a leading edge extending away from and back toward the inner surface is provided. The leading edge, curved member, and inner surface define a first volume for receiving a conductive element. The conductive element is positioned within the first volume of the crimp connector, a portion of the conductive element positioned within the first volume defining a second volume.

A crimping force is applied to the electrically conductive member sufficient to cause the leading edge to contact and move along the inner surface until the first volume is substantially the same as a second volume defined by the portion of the conductive element received within the first volume.

Embodiments of the above aspects can include one or more of the following features. The inner surface includes a first section having a flat surface and a second section having an arcuate surface. The leading edge is positioned proximally to the inner surface when the crimp connector is in an uncrimped position. The leading edge can be chamfered or radiused. The crimp connector can include rib deformations extending circumferentially around the electrically conductive terminal. The rib deformations can include sharp edges. The inner surface can be connected to the rolled rail fastener and maintained in proper alignment during the crimp process by gusset elements. The electrically conductive terminal can include at least one opening which is configured to allow the positioning of an anti mis-insertion element. The conductive elements can be housed within an insulator containing an anti mis-insertion feature. The crimp connector can also include a rolled rail fastener connected to the electrically conductive curved member. The rolled rail fastener can include at least one electrically conductive crimp terminal.

The conductive element can be in the form of a wire, for example, a multi-strand electrical conductor. The conductive element can be in the form of a termination or lead of an electronic component. The conductive elements can be housed within an insulator containing stress accumulators in the conductive element entry area. The stress accumulators redirect crimp forces away from dielectrically sensitive surface areas that would otherwise fracture during the crimp process.

Among other advantages, deforming the barrel reduces the overall volume of the interior of the crimp barrel. The reduction of the interior volume increases the contact area of the wire to the barrel, thereby allowing a higher level of current or amperage to flow through the crimp connector without the crimp connector heating beyond an acceptable temperature. The increased contact area also provides for increased heat dissipation, thereby increasing the life and reliability of the device.

The stress accumulators provide a controlled fracture and prevent the fracture from extending to a more critical area. Stress accumulators redirect crimp forces away from dielectrically sensitive surface areas that would otherwise fracture during the crimp process.

DESCRIPTION

Figure 1A:
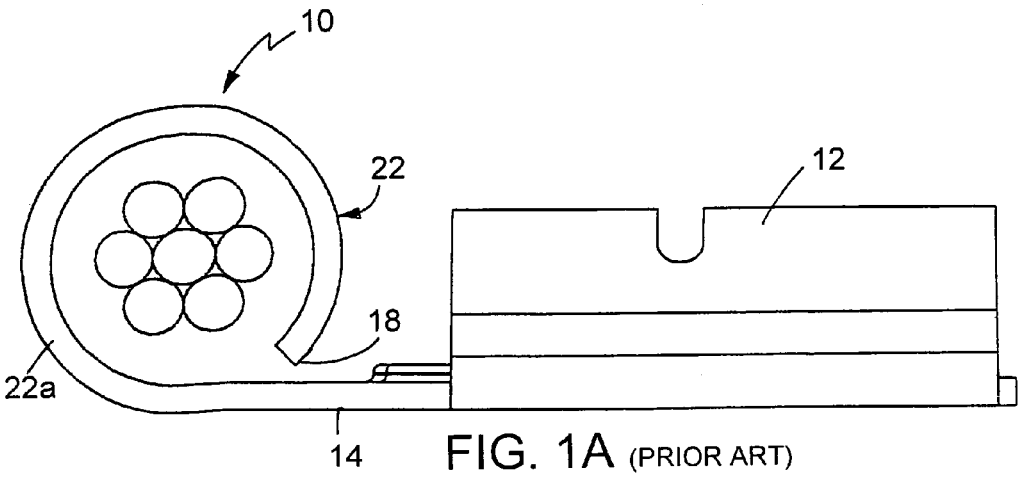
FIG. 1A (PRIOR ART)
FIG. 1A is a side view of crimp connector in an uncrimped condition.
Figure 1B:
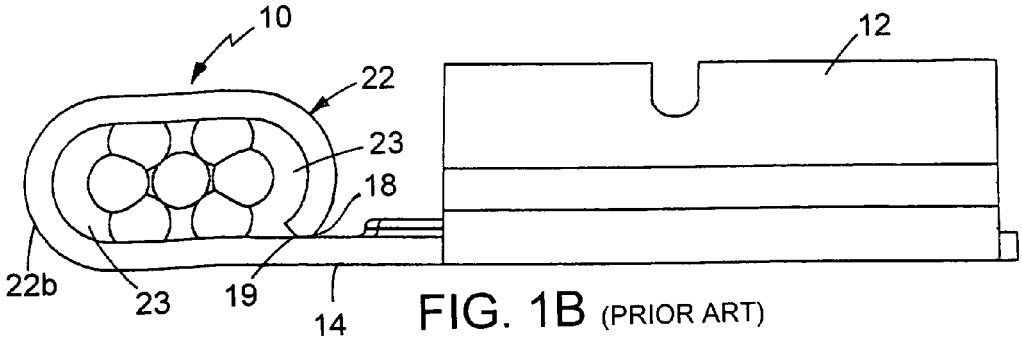
FIG. 1B (PRIOR ART)
FIG. 1B is a side view of crimp connector of FIG. 1A in a crimped condition.
Figure 2:
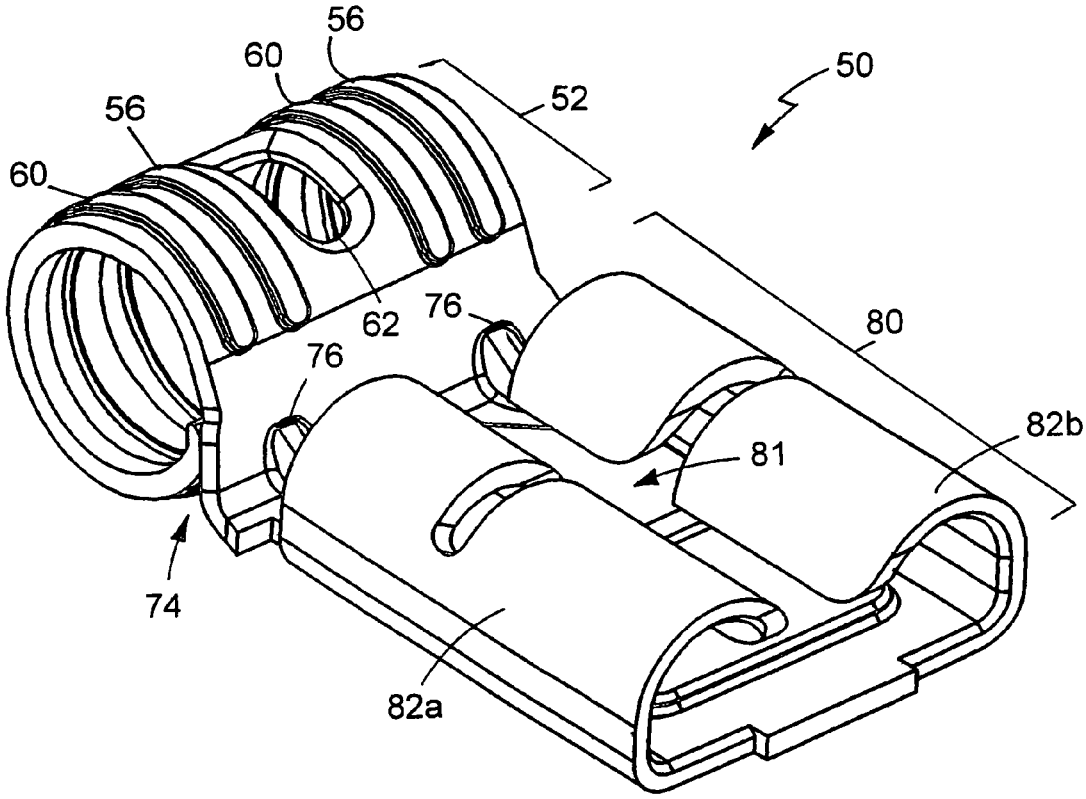
FIG. 2 is a perspective view of a crimp connector.

Referring to FIG. 2, a crimp connector 50 is shown to include two sections: a crimp barrel 52 and a rolled-rail fastener 80, which is electrically and mechanically connected to the crimp barrel. Crimp barrel 52 is crimpable and, as will be described in greater detail below, is shaped to accept a wire (e.g., single or multi-stranded conductor) and with the application of force deforms to establish the electrical connection to the wire. Rolled-rail fastener 80, on the other hand, is configured to receive a bladed conductor (not shown).

A transition member 74 extends between rolled-rail fastener 80 and crimp barrel 52. A pair of conductive extensions 76 extends from the crimp barrel 52 to the fastener 80 to provide mechanical support between the barrel 51 and the fastener 80.

Referring to FIGS. 3A–3D, transition member 74 is shaped and sized to direct a leading edge of crimp barrel 52 in a particular manner such that, in its crimped condition, any space between the wire or conductor and the volume defined by crimp barrel 52 is minimized. Put another way, upon completion of the crimping operation, the volume defined by crimp barrel 52 is substantially the same as the volume of the wire encompassed by the crimp barrel. To achieve such a crimping operation for providing an improved electrical and mechanical connection, a single axial operation causes a two-step process to be performed.

Figure 3A:
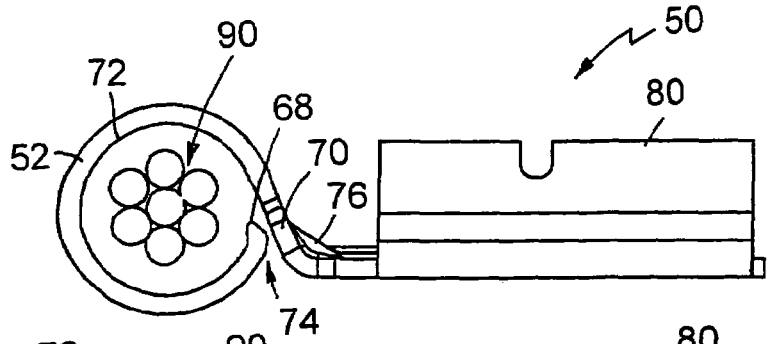
FIGS. 3A–3D illustrate side views of the crimping process for the crimp connector of FIG. 2.
Figure 3B:
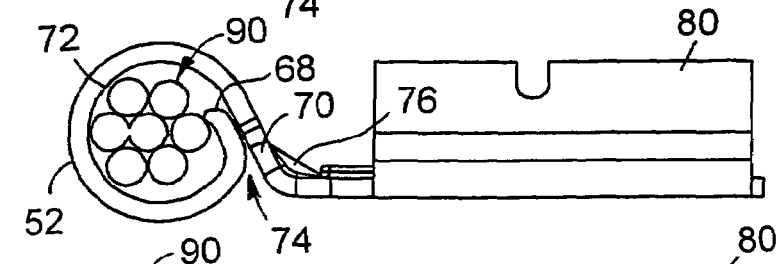

As shown in FIG. 3A, in the un-crimped condition the leading edge 68 of crimp connector 50 is proximate to an inner, gliding surface 70 of crimp barrel 52. A user inserts a wire 90 (e.g., single or multi-strand conductor) into the crimp barrel 52 and applies a crimping force using a crimping tool (e.g., a gamma applicator press). Leading edge 68, relative to gliding surface 70, is slightly offset from perpendicular. Unlike the remainder of crimp barrel 52 which is substantially cylindrical, gliding surface 70 is substantially linear and flat so that, as a crimping force is applied, leading edge 68 moves along flat gliding surface 70 (FIG. 3B). Gliding surface 70 is flat to reduce contact friction between the gliding surface and the leading edge 68 and to minimize the possibility that the leading edge could hang-up or "stub" during crimping.

Figure 3C:
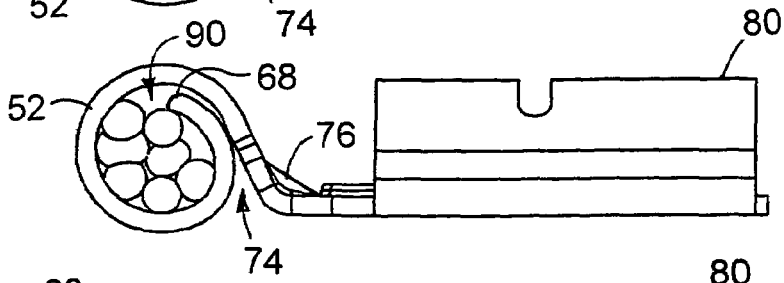

The application of a crimping force causes the leading edge 68 to first move vertically upward until it contacts gliding surface 70. During the period in which leading edge 68 moves along gliding surface 70, the majority of the reduction in volume caused by crimping occurs. As crimping force is further applied, leading edge 68 moves beyond flat, gliding surface 70 and continues to move along inner surface 72 of crimp barrel 52, spiraling inward until crimp barrel 52 is tightly wound around the wire (FIG. 3C).

Figure 3D:
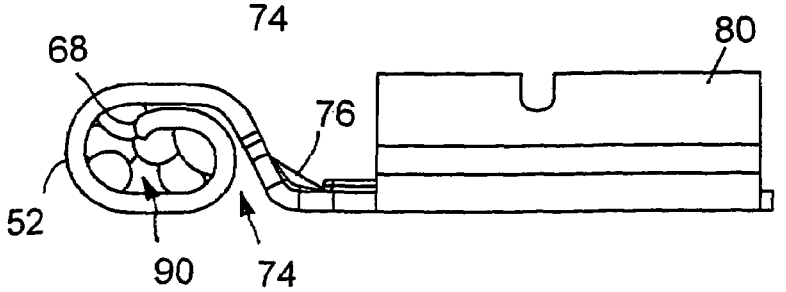
Figure 5A:
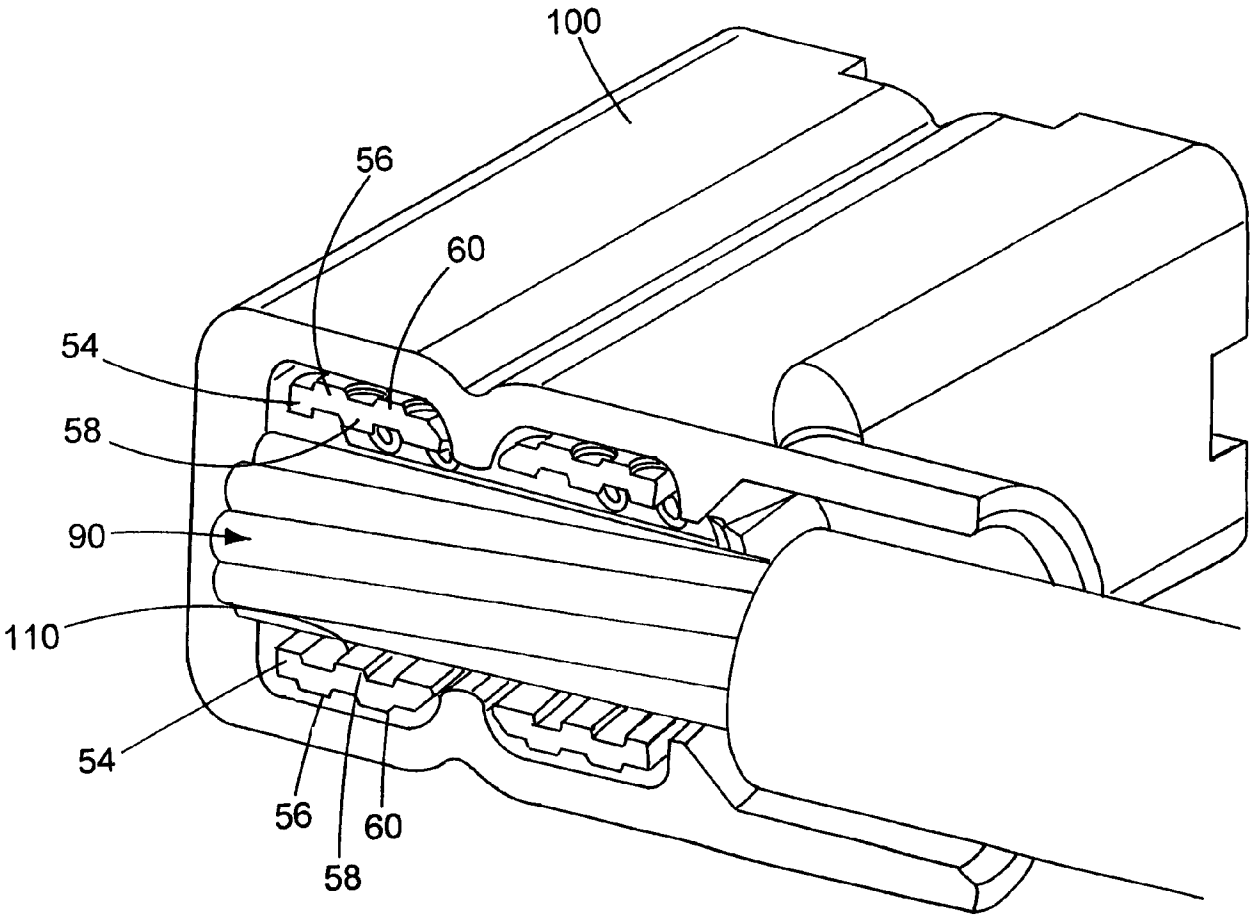
FIG. 5A shows a multi-stranded wire positioned within the connector and housing unit of FIG. 4.

In preferred embodiments, leading edge 68 has a radiussed or chamfered end 69 for facilitating movement of the leading edge as it moves along inner surface 70. In particular, when leading edge 64 reaches the gliding surface 70, chamfered end 69 directs leading edge 68 in an upward gliding motion into gliding surface, further reducing the possibility of the leading edge stubbing against the gliding surface. Once leading edge moves beyond gliding surface 70, leading edge continues in spiral manner until wire 90 is completely or nearly completely encircled (FIG. 3B). At that point, further crimping distorts the spiral shape and firmly attaches the crimp barrel 52 to the conductive element 90. Following the spiral motion, the barrel is flattened into an oval shape (FIG. 3D). As will be discussed in greater detail below in conjunction with FIGS. 5A and 5B, at this point, crimp barrel 52 includes sharp-edged ribs, which penetrate the wire.

As shown in FIGS. 3A and 3B, the crimping minimizes or virtually eliminates the space surrounding the conductor 90. This reduction in interior volume-provides several advantages. For example, a crimp connector 50 can be used with multiple thicknesses of conductive element 90. Reducing the interior volume increases the contact area of the wire to the electrically conductive inner surface 64; thus allowing higher levels of electrical current to flow through the crimp connector 50 without the crimp connector 50 heating beyond an acceptable temperature. The increased contact area also provides increased heat dissipation and a more reliable connection, reducing the likelihood of the conductor coming loose from the crimp connector 50.

The crimp connector 50 may be used with and fitted within a protective housing unit 100. When a bladed conductor is inserted into the rolled-rail fastener 80 of the crimp connector 50, an electric current path is provided between the wire crimped within the barrel 52 and the bladed conductor in the fastener.

Figure 4:
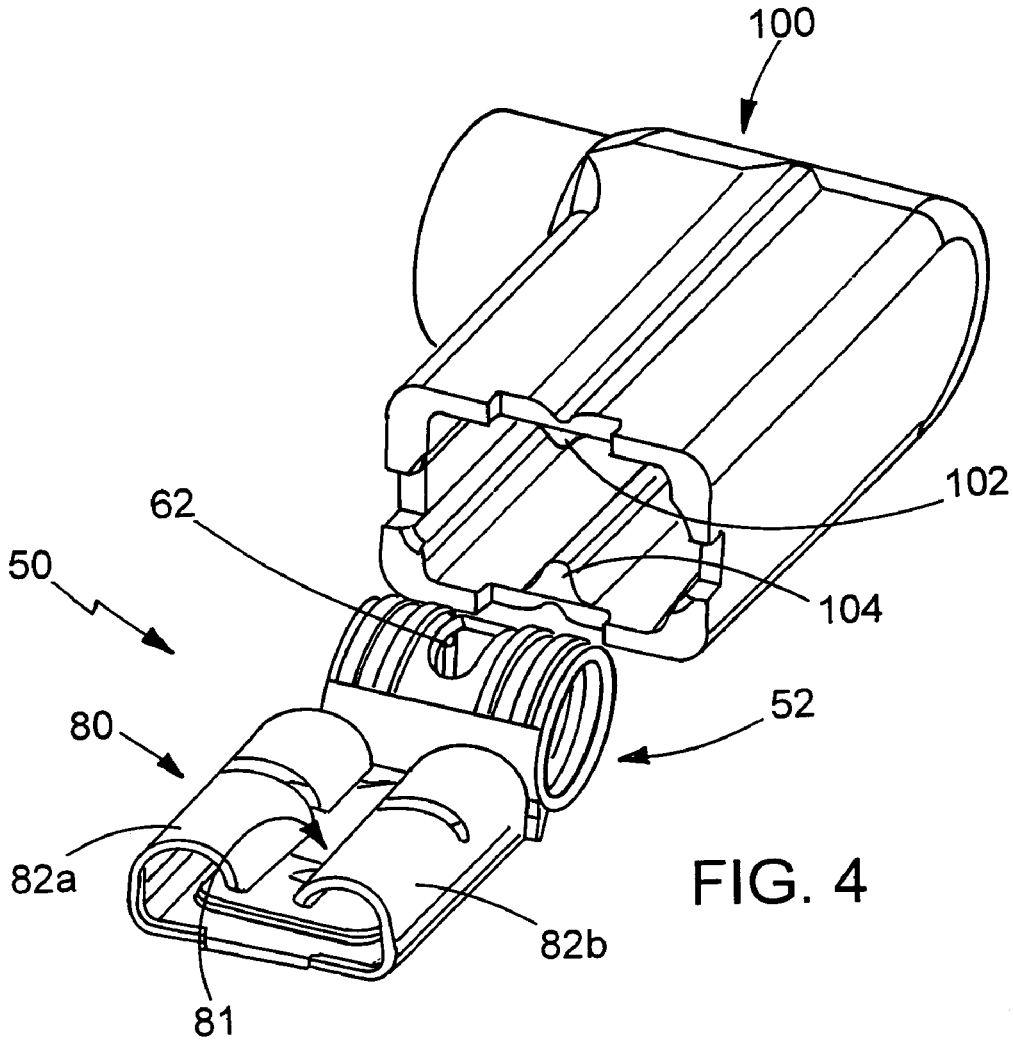
FIG. 4 is a perspective view of the crimp connector of FIG. 2 and a housing unit for use with the crimp connector.

Referring to FIG. 4, protective, insulating housing 100 includes a pair of rails 102, 104 formed on an interior surface of the housing 100 that extend to rail fastener 80. Upper rail 102 is received within a space 81 between opposing conductors 82*a*, 82*b* of rolled-rail fastener 80. Crimp barrel 52 includes an opening or slot 62 (only the top slot is shown) that allows rails 102, 104 to extend to space 81.

Figure 5B:
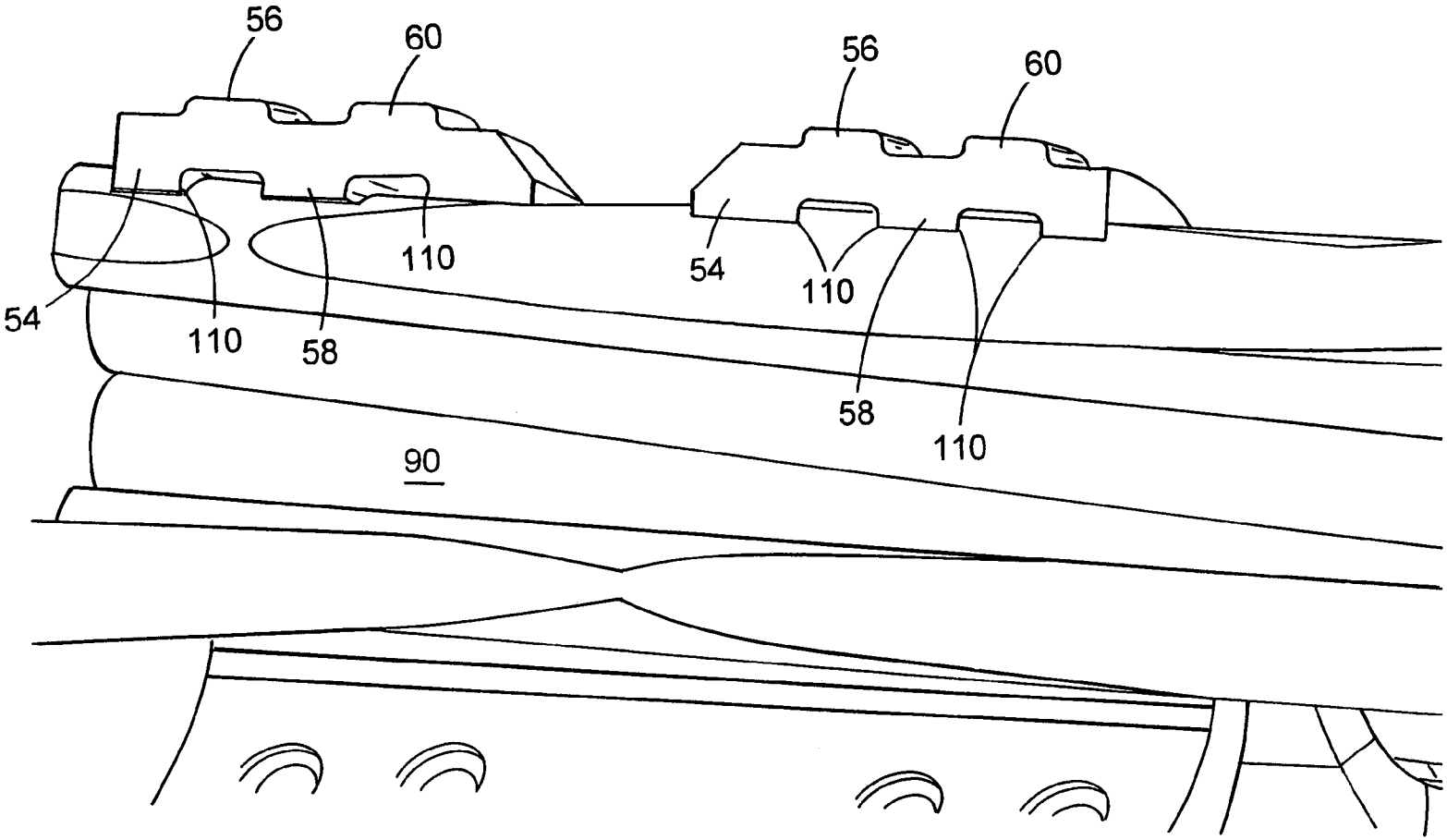
FIG. 5B is an enlarged, cross-sectional view of the conductor and the connector of FIG. 5A.

Referring again to FIG. 2 and FIG. 5A, crimp barrel 52 includes a set of ribs 54, 56, 58, and 60 formed on the interior surface 64 of the barrel 51 and each having sharp edges 110. Referring to FIG. 5B, during the crimp process, the sharp edges 110 of the ribs penetrate the surface of a wire 112 and engage the wire ensuring current flow between barrel 52 and providing a mechanically secure connection to the barrel 52.

Figure 6:
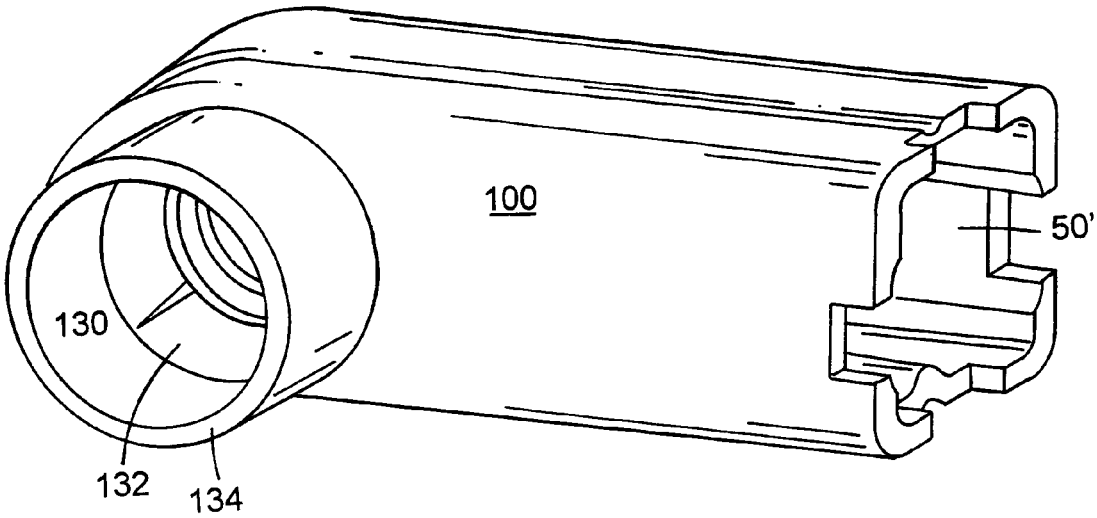
FIG. 6 is a side view of a housing unit including a stress accumulator.

Referring to FIG. 6, a crimp connector 50' inserted into the insulating housing 100 is shown. In this embodiment, the insulating housing 100 includes stress accumulators 130 in a throat 132 of the wire entry 134 (only one shown). The stress accumulators 130 have a smaller cross section than adjacent areas. If the crimp action impacts the wire entry 134 area with enough force to fracture the plastic, a controlled fracture of the stress accumulators 130 occurs. The controlled fracture prevents the force from generating a fracture that could extend into more critical areas.

A single stress accumulator may be included in the wire entry 134, or multiple stress accumulators may be spaced around the wire entry 134. To generate a controlled fracture, a set of multiple (e.g., 4, 5, 6, etc.) stress accumulators 130 may be evenly spaced within the wire entry 134.

A number of embodiments of the invention have been described. Nevertheless, it will be understood that various modifications may be made without departing from the spirit and scope of the invention. Accordingly, other embodiments are within the scope of the following claims.

What is claimed is:

1. A crimp connector comprising:

an electrically conductive curved member including an inner surface and a leading edge extending away from and back toward the inner surface, the leading edge, curved member, and inner surface defining an adjustable first volume for receiving a conductive element, the electrically conductive curved member, in response to an external crimping force, configured to cause the leading edge to contact and move along the inner surface until the first volume is substantially the same as a second volume defined by the portion of the conductive element received within the first volume.

2. The crimp connector of claim 1 wherein the inner surface includes a first section having a flat surface.

3. The crimp connector of claim 2 wherein the flat surface is configured to reduce contact friction between the leading edge and the flat surface.

4. The crimp connector of claim 1 wherein the inner surface includes a second section having an arcuate surface.

5. The crimp connector of claim 1 wherein the leading edge is positioned proximal to the first section of the inner surface in an uncrimped condition.

6. The crimp connector of claim 1 wherein the leading edge is chamfered.

7. The crimp connector of claim 1 wherein the leading edge is radiused.

8. The crimp connector of claim 1 further comprising a plurality of deformations extending circumferentially around the electrically conductive curved member.

9. The crimp connector of claim 8 wherein the deformations include a plurality of sharp edges.

10. The crimp connector of claim 1 further comprising a rolled rail fastener connected to the electrically conductive curved member.

11. The crimp connector of claim 10 wherein the inner surface is connected to the rolled rail fastener and maintained in proper alignment during the crimp process by a plurality of gusset elements.

12. The crimp connector of claim 10 further comprising a housing for receiving the electrically conductive curved member, and the rolled rail fastener.

13. The crimp connector of claim 12 wherein the housing includes an anti-misinsertion element to facilitate insertion of a bladed conductor into the rolled rail fastener.

14. The crimp connector of claim 13 wherein the anti-misinsertion element includes at least one of: a rail, a projecting rib.

15. The crimp connector of claim 12 wherein the housing includes a plurality of stress accumulators.

16. The crimp connector of claim 10 wherein the rolled rail fastener includes at least one electrically conductive crimp terminal.

17. The crimp connector of claim 16 wherein the electrically conductive curved member is configured to receive a multi-stranded wire.

18. The crimp connector of claim 1 wherein the electrically conductive curved member is configured to receive a wire.

19. The crimp connector of claim 1 wherein the electrically conductive member, in response to the external crimping force and following contacting the inner surface, is configured to move along a flat surface of the inner surface and then along an arctuate surface of the inner surface.

20. A method comprising:

providing a crimp connector including an electrically conductive curved member including an inner surface and a leading edge extending away from and back toward the inner surface, the leading edge, curved member, and inner surface defining an adjustable first volume for receiving a conductive element;

positioning the conductive element within the first volume of the crimp connector, a portion of the conductive element positioned within the first volume defining a second volume;

applying a crimping force to the electrically conductive member sufficient to cause the leading edge to contact and move along the inner surface until the first volume is substantially the same as a second volume defined by the portion of the conductive element received within the first volume.

21. The method of claim 20 wherein the inner surface includes a first section having a flat surface.

22. The method of claim 20 wherein the inner surface includes a second section having an arcuate surface.

23. The method of claim 21 further comprising configuring the flat surface to reduce contact friction between the leading edge and the flat surface.

24. The method of claim 20 comprising providing a chamfer to the leading edge.

25. The method of claim 20 comprising providing a radius to the leading edge.

26. The method of claim 20 comprising providing a plurality of deformations to the electrically conductive curved member, the deformations extending circumferentially around the electrically conductive curved member.

27. The method of claim 26 comprising providing a sharp edge to the plurality of deformations.

28. The method of claim 20 further comprising providing a housing for receiving the electrically conductive curved member.

29. The method of claim 28 wherein the housing includes an anti-misinsertion element to facilitate insertion of a bladed conductor into a rolled rail fastener connected to the electrical conductive curved member.

30. The method of claim 29, wherein the anti-misinsertion element includes at least one of: a rail, a projecting rib.

31. The method of claim 20 further comprising configuring the electrically conductive member, in response to the external crimping force and following contacting the inner surface, to move along a flat surface of the inner surface and then along an arctuate surface of the inner surface.

* * * * *